US010165793B2

(12) United States Patent
Makboul

(10) Patent No.: US 10,165,793 B2
(45) Date of Patent: Jan. 1, 2019

(54) SMOKING PRODUCT ROLLING AND FORMING DEVICES

(71) Applicant: Ammar Makboul, Portland, OR (US)

(72) Inventor: Ammar Makboul, Portland, OR (US)

( * ) Notice: Subject to any disclaimer, the term of this patent is extended or adjusted under 35 U.S.C. 154(b) by 74 days.

(21) Appl. No.: 15/440,363

(22) Filed: Feb. 23, 2017

(65) Prior Publication Data

US 2017/0238601 A1 Aug. 24, 2017

Related U.S. Application Data

(60) Provisional application No. 62/298,589, filed on Feb. 23, 2016, provisional application No. 62/356,153, filed on Jun. 29, 2016.

(51) Int. Cl.

| | |
|---|---|
| ***A24C 5/42*** | (2006.01) |
| ***A24C 5/52*** | (2006.01) |
| ***A24D 3/02*** | (2006.01) |

(52) U.S. Cl.

CPC ..... *A24C 5/42* (2013.01); *A24C 5/52* (2013.01); *A24D 3/0229* (2013.01)

(58) Field of Classification Search

None

See application file for complete search history.

(56) References Cited

U.S. PATENT DOCUMENTS

| | | | | |
|---|---|---|---|---|
| 2,425,888 | A * | 8/1947 | Matteson | A24C 5/42 131/70 |
| 3,645,272 | A * | 2/1972 | Jenkins | A24C 5/425 131/75 |
| D448,316 | S | 9/2001 | Kesselman | |
| D455,092 | S | 4/2002 | Kesselman | |
| D472,832 | S | 4/2003 | Kesselman | |
| D486,088 | S | 2/2004 | Kesselman | |
| D488,732 | S | 4/2004 | Kesselman | |
| 6,833,515 | B1 | 12/2004 | Kesselman | |
| D504,342 | S | 4/2005 | Kesselman | |
| D505,873 | S | 6/2005 | Kesselman | |

(Continued)

OTHER PUBLICATIONS conefiller.com, The All New, Revolutionary! Barracuda Cone Filler, at least as early as Mar. 13, 2017, 3 pages, http://www.conefiller.com/index.html.

(Continued)

*Primary Examiner* — Dennis R Cordray

(74) *Attorney, Agent, or Firm* — Chernoff Vilhauer LLP

(57) ABSTRACT

Packing tools and systems and methods for using a packing tool to hand-make smoking products are disclosed. In some embodiments, the packing tool may include an elongate body having a first tamping end and a second tamping end opposite the first tamping end, and a handle attached to, or formed with, the elongate body. The handle may be disposed between the first and second tamping ends. The first tamping end may have a first width sized to fit within a filter end of a smoking product. The second tamping end may have a second width sized to fit within an ignition end of a smoking product. The packing tool may additionally include a single row of troughs configured to distribute material of a smoking product, a set of ruler markings proximate the first tamping end, and a paper curling portion disposed between the handle portion and second tamping end.

19 Claims, 8 Drawing Sheets

(56) References Cited

U.S. PATENT DOCUMENTS

| | | | |
|---|---|---|---|
| D509,159 | S | 9/2005 | Kesselman |
| D518,398 | S | 4/2006 | Kesselman |
| D519,048 | S | 4/2006 | Kesselman |
| D520,889 | S | 5/2006 | Kesselman |
| D521,889 | S | 5/2006 | Kesselman |
| D533,798 | S | 12/2006 | Kesselman |
| 7,193,163 | B1 | 3/2007 | Kesselman |
| 7,256,357 | B1 | 8/2007 | Kesselman |
| D550,108 | S | 9/2007 | Kesselman |
| D550,109 | S | 9/2007 | Kesselman |
| D550,110 | S | 9/2007 | Kesselman |
| D554,013 | S | 10/2007 | Kesselman |
| 7,377,281 | B2 | 5/2008 | Bachmann |
| D576,064 | S | 9/2008 | Kesselman |
| D578,420 | S | 10/2008 | Kesselman |
| D578,421 | S | 10/2008 | Kesselman |
| D588,032 | S | 3/2009 | Kesselman |
| D596,517 | S | 7/2009 | Kesselman |
| D596,518 | S | 7/2009 | Kesselman |
| D596,519 | S | 7/2009 | Kesselman |
| D596,971 | S | 7/2009 | Kesselman |
| D596,972 | S | 7/2009 | Kesselman |
| D606,245 | S | 12/2009 | Kesselman |
| D606,858 | S | 12/2009 | Kesselman |
| D623,538 | S | 9/2010 | Kesselman |
| 8,393,332 | B2 | 3/2013 | Kesselman |
| D682,128 | S | 5/2013 | Kesselman |
| D682,129 | S | 5/2013 | Kesselman |
| D682,130 | S | 5/2013 | Kesselman |
| 8,584,854 | B2 | 11/2013 | Kesselman et al. |
| 8,662,086 | B2 | 3/2014 | Kesselman |
| D719,715 | S | 12/2014 | Kesselman |
| D726,389 | S | 4/2015 | Kesselman |
| 9,072,319 | B2 | 7/2015 | Kesselman |
| 9,161,572 | B2 | 10/2015 | Kesselman et al. |
| 2004/0003947 | A1 | 1/2004 | Kesselman et al. |
| 2008/0185010 | A1 | 8/2008 | Kesselman et al. |
| 2009/0014342 | A1 | 1/2009 | Kesselman et al. |
| 2009/0020443 | A1 | 1/2009 | Kesselman |
| 2010/0043808 | A1 | 2/2010 | Kesselman |
| 2011/0030710 | A1 | 2/2011 | Kesselman |
| 2012/0138075 | A1* | 6/2012 | Jespersen ..... A24C 5/40 131/280 |
| 2015/0090275 | A1 | 4/2015 | Kesselman et al. |
| 2017/0013873 | A1* | 1/2017 | Green ..... A24C 5/40 |
| 2017/0042218 | A1* | 2/2017 | Sinclair, Jr. ..... A24D 1/022 |
| 2017/0238601 | A1* | 8/2017 | Makboul ..... A24C 5/42 |

OTHER PUBLICATIONS amazon.com, 1 X Cone Artist Cone Roller, at least as early as May 29, 2015, 6 pages, http://www.amazon.com/Cone-Artist-Roller/dp/B00V2KL5CY.

ryocones.com, The Cone Roller, at least as early as Mar. 6, 2015, 4 pages, http://ryocones.com/home-the-cone-roller-1-cone-rolling-device-on-the-market.html.

rawthentic.com, Raw Cone, Feb. 22, 2017, 4 pages, http://rawthentic.com/1-%C2%BC-classic-cones/.

* cited by examiner

SMOKING PRODUCT ROLLING AND FORMING DEVICES

CROSS-REFERENCE TO RELATED APPLICATIONS

This application claims priority to U.S. Provisional Patent Application Ser. No. 62/298,589, filed Feb. 23, 2016, and U.S. Provisional Patent Application Ser. No. 62/356,153, filed Jun. 29, 2016. The complete disclosures of the above applications are hereby incorporated by reference in their entirety for all purposes.

FIELD OF THE DISCLOSURE

This disclosure generally relates to devices and methods for making smoking products. More specifically, the disclosed embodiments relate to systems, apparatus, and methods for hand-making smoking products.

BACKGROUND OF THE DISCLOSURE

Some smokers prefer the process of making their own smoking products (e.g., cigarettes, cigars, etc.) to buying pre-rolled and pre-packaged smoking products. For example, the individual components of a cigarette, such as tobacco and cigarette papers, when purchased in bulk, are often less expensive per cigarette than pre-made cigarettes. In the case of marijuana cigarettes, it may not be possible to purchase pre-rolled cigarettes, even in states where the recreational or medical use of marijuana is legal. In addition, some people find enjoyment in making their own cigarettes, and may even consider cigarette-rolling to be a challenging endeavor in which to demonstrate skill.

One way to make cigarettes individually and manually is to place an amount of loose tobacco in a cigarette paper and roll it between one's fingers. However, this approach is limited in that it is somewhat difficult to produce a cigarette of uniform shape and fill, and outside influences (for example, bad weather in an outdoor setting, or jostling from other people in a crowded area) may increase the difficulty.

Relatively small and simple devices that allow a user to make cigarettes are available; however, such devices small enough to fit comfortably in one's hand or on a table may not be capable of rolling consistently a high-quality cigarette. Other devices, though capable of improved function, may be too large to be carried easily in a pocket or handbag, if they may be carried at all. Often these devices include multiple rollers and looped belts, and the number of moving parts may make the devices prone to breaking or malfunctioning.

SUMMARY OF THE DISCLOSURE

Some embodiments provide a packing tool. In some embodiments, the packing tool may include an elongate body having a first tamping end and a second tamping opposite the first tamping end, and a handle attached to, or formed with, the elongate body. The handle may be disposed between the first and second tamping ends, and the handle may extend outwards from the elongate body. The elongate body may include a single row of troughs configured to distribute material of a smoking product. The first tamping end may have a first width sized to fit within a filter end of a smoking product and the second tamping end may have a second width sized to fit within an ignition end of a smoking product. The second width may be larger than the first width. The packing tool may additionally include a set of ruler markings proximate the first tamping end, and a paper curling portion configured to allow a user to curl a portion of filter paper.

Some embodiments provide a system for hand-making smoking products. The system for hand-making smoking products may include a packing tool, at least one cone, and a funnel. The packing tool may have an elongate body having a first tamping end and a second tamping opposite the first tamping end, a handle attached to, or formed with, the elongate body, a set of ruler markings, and a paper curling portion. The elongate body may have a single row of troughs configured to distribute material of a smoking product. The at least one cone may have an outer surface configured about which to roll a rolling paper, the funnel may have an output end sized to fit within an ignition end of the rolled rolling paper so as to fill the rolled rolling paper with plant material, the first tamping end of the packing tool may have a first width sized to fit within a filter end of the rolled rolling paper and through the funnel, and the second tamping end of the packing tool has a second width sized to fit within the ignition end of the rolled rolling paper. In some embodiments, the at least one cone may include a first cone and a second cone. The second cone may have different dimensions than the first cone. The system for hand-making smoking products may additionally include a flexible cylindrical tube configured to receive an existing smoking product. In some embodiments, the packing tool may be configured to be received in the funnel, a portion of the funnel may be configured to be received within the first cone, a portion of the first cone may be configured to be received within the second cone, and a portion of the second cone may be configured to be received within the flexible cylindrical tube.

Some embodiments provide a method for hand-making smoking products. The method may include inserting a funnel into the ignition end of a shell, urging plant material through the funnel into the shell with a first tamping end of a packing tool, thereby filling the shell with plant material, and tamping the plant material in the shell proximate the ignition end with a second tamping end of the packing tool. The method may additionally include inserting a rolled filter paper into the filter end. The method may further include measuring a depth of space for the rolled filter paper within the filter end with the set of ruler markings. In some embodiments, the method may include tamping the plant material in the shell proximate the filter end with the first tamping end of the packing tool.

DETAILED DESCRIPTION OF THE DISCLOSURE

The present disclosure may illustrate and describe a number of embodiments of packing tools and of systems, apparatus, and methods for hand-making smoking products using a packing tool in the present drawings and specification. Unless otherwise specified, the packing tool, a system, an apparatus, or a method and/or its various components may contain at least one of the structures, components, functionality, and/or variations described, illustrated, and/or incorporated herein. Furthermore, the structures, components, functionalities, and/or variations described, illustrated, and/or incorporated herein in connection with the present teachings may be included in other similar systems, apparatus, and methods. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

In the present disclosure, the term "cigarette" is taken more generally than a paper cylinder containing tobacco for smoking. "Cigarette" refers to any individual smoking product, including standard cigarettes that can be purchased in a store as well as cigarettes which have been hand-rolled by an individual or machine-rolled, cigars, joints, doobies, blunts, spliffs, etc., and/or the like, and containing any of tobacco, marijuana, narcotic(s), herb(s), medicated substance(s), and/or any other material(s) for smoking.

Figure 1:
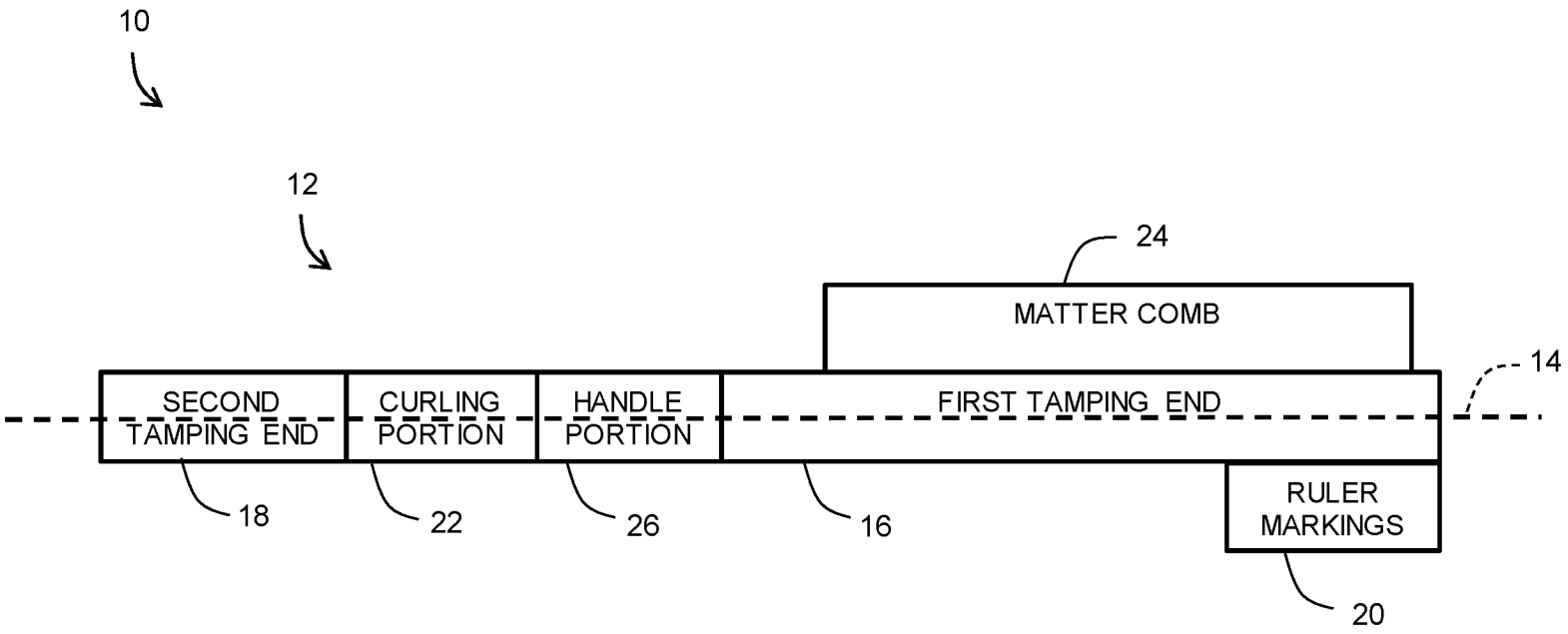
FIG. 1 is a block diagram of an example of a packing tool.

FIG. 1 is a block diagram of an example of a packing tool, generally indicated at 10. Packing tool 10 may be used by itself or as part of a larger hand-making smoking product system. The packing tool may be a multi-purpose tool capable of performing many functions associated with hand-making a cigarette (or smoking product). For example, packing tool 10 may include an elongate body 12 having a longitudinal axis 14, a first tamping end 16, a second tamping end 18, a set of ruler markings 20 proximate the first tamping end, a paper curling portion 22, a matter comb 24, and/or a handle portion 26. In other examples, packing tool 10 may include more or less components. For example, packing tool 10 may include an elongate body, a first tamping end, a second tamping end, a matter comb, and a handle portion, but no paper curling portion or set of ruler markings.

The elongate body 12 of packing tool 10 may be formed of a unitary construction of plastic, metal, wood, or any other appropriate material. Alternately, packing tool 10 may be formed of more than one piece or material, the distinct materials coupled together in a suitable fashion.

Packing tool 10 may be generally disposed along the longitudinal axis 14. Different sections or portions of packing tool 10 may have different cross-sectional shapes and sizes. Different sections or portions of the packing tool may have azimuthal symmetry about the longitudinal axis, while other sections or portions may have substantially no azimuthal symmetry.

The first tamping end 16, the handle portion 26, the paper curling portion 22, and the second tamping end 18 may be disposed sequentially along the longitudinal axis 14. That is, the first and second tamping ends may form opposite ends of the packing tool 10, with the handle portion and the paper curling portion disposed intermediate the first and second tamping ends, the handle portion proximate the first tamping end, and the paper curling portion proximate the second tamping end, though other arrangements are also possible.

The first tamping end 16 of the packing tool may have many uses associated with hand-making cigarettes. In the case where a funnel is used to fill a rolled rolling paper with plant material, the first tamping end of the packing tool may be used to urge plant material through the funnel and into the rolled rolling paper. When a rolling paper has been suitably filled with plant material, the first tamping end may be used to tamp or pack the plant material proximate one end of the rolled paper. For example, the first tamping end of the packing tool may have a first diameter sized to fit within a filter end of a rolled rolling paper.

The second tamping end 18 of the packing tool may be useful with hand-making cigarettes. For example, in the case when a rolling paper has been suitably filled with plant material, the second tamping end may be used to tamp or pack the plant material proximate one end of the rolled paper. The second tamping end of the packing tool may have a second diameter sized to fit within an ignition end of a rolled rolling paper.

The set of ruler markings 20 proximate the first tamping end may allow the first tamping end of the packing tool to function as a ruler. For example, after plant material has been filled into a rolled rolling paper and tamped or packed down proximate one end of the cigarette, the first tamping end may be inserted into that end and the set of ruler markings used to measure a depth of space proximate that end of the cigarette. Such a space could subsequently be filled with a filter paper. Measuring the depth with the set of ruler markings may allow a user to add an appropriately sized filter paper. The set of ruler markings may be drawn or otherwise printed on an outside surface of the packing tool proximate the first tamping end. Alternately, the set of ruler markings may be a set of regularly spaced notches recessed in the body 12 of the packing tool.

The paper curling portion 22 may allow a user to curl a portion of filter paper. A user may choose to insert a rolled filter paper into a filter end of a hand-rolled or hand-made cigarette. It may be easier to roll the filter paper if the filter paper has first been curled. The paper curling portion may include a curling edge disposed parallel to the longitudinal axis. If a user drags a flat portion of filter paper across the curling edge, the portion of filter paper may become curved, much as how ribbon may be curled by dragging the ribbon across a sharp edge of a pair of scissors.

Matter comb 24 may be useful with hand-making cigarettes. For example, when a user rolls a cigarette using only rolling paper, plant material, and the user's own hands, the matter comb may be configured to adjust the distribution of plant material with respect to the rolling paper. Certain kinds of smokable plant material may stick to a user's fingers, thus making achieving an even distribution of plant material within a cigarette difficult. The matter comb may allow a user to move the plant material around on the rolling paper without having to use their fingers. The matter comb may be a serrated edge, or a series of elevations separated by troughs recessed in the body of the packing tool.

Handle portion 26 may provide a convenient location along body 12 for a user to hold the packing tool 10 while using the packing tool to hand-make a cigarette. In particular, when using the paper curling portion 22 it may be advantageous to hold the packing tool at the handle portion which may be disposed adjacent the paper curling portion. Handle portion 26 may have an enlarged lateral dimension as compared to both the paper curling portion 22 and the first tamping end 16, where lateral is generally perpendicular to the longitudinal axis 14 of the packing tool.

Figure 2:
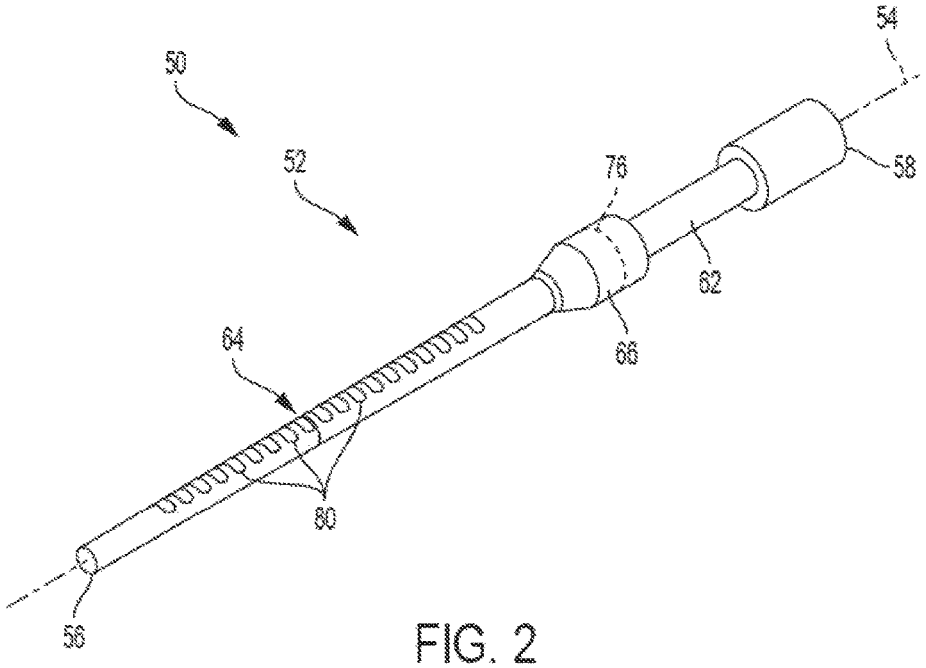
FIG. 2 is an isometric view of an example of the packing tool of FIG. 1.
Figure 3:
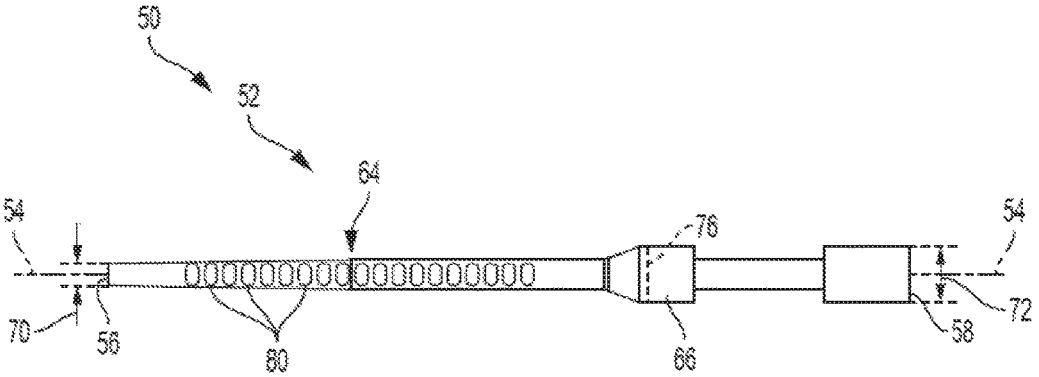
FIG. 3 is a top view of the packing tool of FIG. 2.

FIGS. 2-3 show an example of packing tool 10, which is generally indicated at 50. Unless explicitly excluded, packing tool 50 may include one or more components and/or one or more functions of other packing tools described in the present disclosure. Packing tool 50 may include an elongate body 52 having a longitudinal axis 54, a first tamping end 56, a second tamping end 58, a paper curling portion 62, a matter comb 64, and/or a handle portion 66. Packing tool 10 may be used as part of system 200 described below, or may be used alone.

As shown in FIG. 3, the first tamping end 56 of the packing tool may have a first diameter 70 sized to fit within a filter end of a rolled rolling paper. The second tamping end 58 of the packing tool may have a second diameter 72 sized to fit within an ignition end of a rolled rolling paper. For example, first diameter 70 may have a diameter of approximately 6 millimeters and second diameter 72 may have a diameter of approximately 9 millimeters. The first and second tamping ends may have any suitable dimensions and/or shapes. For example, the tamping end may extend a length of approximately 14 millimeters relative to the longitudinal axis. In other examples, the length of the second tamping end may have a length more or less than 14 millimeters.

In some examples, the length between the first tamping end and the second tamping end may have a length of approximately 130 millimeters relative to the longitudinal axis. In other examples, the length may be more or less than 130 millimeters. Further, in some examples, a portion of body 52 between the handle portion and the first tamping end may have a length of approximately 80 millimeters, and a portion of body 52 between the handle portion and the second tamping end may have a length of approximately 35 millimeters. However, many dimensions are possible for the various portions of body 52 of the packing tool.

Curling portion 62 may be disposed between second tamping end 58 and handle portion 66. Curling portion 62 may have any suitable dimensions to facilitate a user curling a portion of paper. For example, curling portion 62 may have a length of approximately 21 millimeters relative to the longitudinal axis, and a diameter of approximately 5 millimeters. In some examples, curling portion 62 may be configured to have a smaller diameter relative to the second tamping end and the handle portion. For example, the curling portion may have a diameter of approximately 5 millimeters, whereas the diameter of the second tamping end and the diameter of the handle portion are approximately 9 millimeters.

Packing tool 50 may include a handle portion 66 with an enlarged lateral dimension 76 as compared to both curling portion 62 and first tamping end 56. That is, the lateral dimension 76 of the handle portion, measured perpendicularly to the longitudinal axis 54, may be larger than the first diameter 70 of the first tamping end. Handle portion 66 may have a length of approximately 14 millimeters running parallel with the longitudinal axis.

Packing tool 50 may include a matter comb 64 configured to adjust the distribution of plant material with respect to a rolling paper or other similar surface. Matter comb 64 may include a plurality of troughs 80 recessed in body 52 of the packing tool. Matter comb 64 may extend between first tamping end 56 and handle portion 66.

Figure 4:
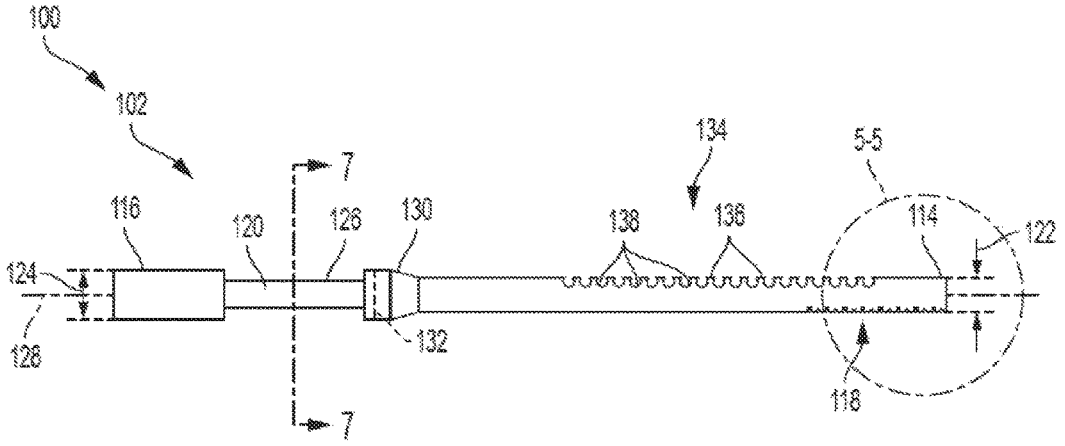
FIG. 4 is a side view of another example of the packing tool of FIG. 1.

FIG. 4 is another example of packing tool 10, which is generally indicated at 100. Unless explicitly excluded, packing tool 100 may include one or more components and/or one or more functions of other packing tools described in the present disclosure. Packing tool 100 may have an elongate body 102 having a longitudinal axis 128, a first tamping end 114, a second tamping end 116, a set of ruler markings 118 proximate the first tamping end, a paper curling portion 120, a handle portion 130, and/or a matter comb 134. Packing tool 100 may be used as part of system 200 described below, or may be used alone.

The first tamping end 114 of the packing tool may have a first diameter 122 sized to fit within a filter end of a rolled rolling paper. The second tamping end 116 of the packing tool may have a second diameter 124 sized to fit within an ignition end of a rolled rolling paper. The paper curling portion 120 may include a curling edge 126 disposed parallel to the longitudinal axis 128 of the packing tool. Curling edge 126 may also be seen in FIG. 7. Curling edge 126 may substantially extend between the second tamping end and the handle portion. In some examples, curling edge 126 may attach to and/or form with one or more portions of the second tamping end and/or handle portion.

Packing tool 100 may include a handle portion 130 with an enlarged lateral dimension 132 as compared to both the paper curling portion 120 and the first tamping end 114. That is, the lateral dimension 132 of the handle portion, measured perpendicularly to the longitudinal axis 126, may be larger than the first diameter 122 of the first tamping end, and a diameter of the paper curling portion.

Packing tool 100 may include a matter comb 134 configured to adjust the distribution of plant material with respect to a rolling paper. Matter comb 134 may include a set of elevations 136 alternating with a set of troughs 138. Elevations 136 and troughs 138 may be better seen in the detailed view of FIG. 5.

Figure 5:
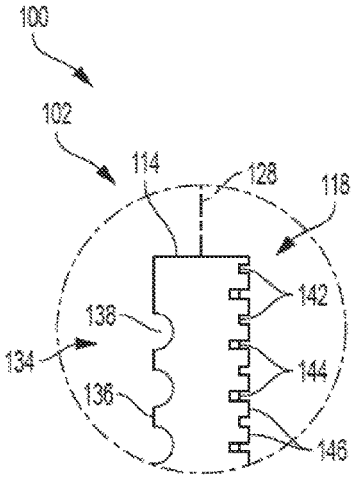
FIG. 5 is a magnified partial view of the packing tool of FIG. 4, as indicated in FIG. 4, showing a portion of a set of ruler markings and a portion of a matter comb.

FIG. 5 is a detailed view, taken at 5-5 in FIG. 4, of packing tool 100, showing a portion of the set of ruler markings 118 and a portion of the matter comb 134. The ruler markings may be a set of regularly spaced notches recessed in body 102 of the packing tool 100. The ruler markings may include a first plurality of notches 142 alternating with a second plurality of notches 144, with plateaus 146 disposed between each adjacent pair of notches. The second plurality of notches 144 may be recessed farther into the body of the packing tool than the first plurality of notches 142. Many shapes and dimensions are possible for the pluralities of notches and the plateaus. For example, the plateaus may have a length of approximately 1.0 millimeter and the notches have a length of approximately 0.5 millimeter, as measured along longitudinal axis 128 of the packing tool. However, other dimensions for the plateaus and notches are included within the scope of the present disclosure.

Many shapes and dimensions are possible for elevations 136 and troughs 138 of matter comb 134. For example, the elevations may have a length of approximately 1.0 millimeter and the troughs may have a length of approximately 2.0 millimeters, as measured along longitudinal axis 128 of the packing tool. However, other dimensions for the elevations and troughs are included within the scope of the present disclosure.

Figure 6:
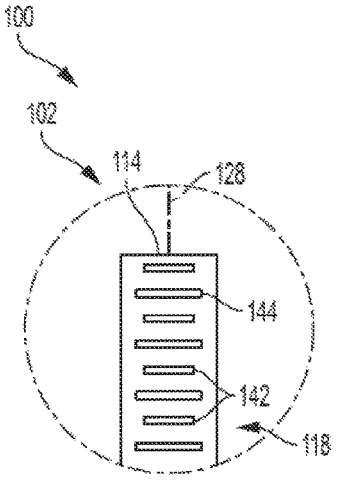
FIG. 6 is an alternate view of the packing tool depicted in FIG. 5, showing a portion of the set of ruler markings.

FIG. 6 is an alternate view of the portion of packing tool 100 depicted in FIG. 5, showing a portion of the set of ruler markings 118. The second plurality of notches 144 may have a greater width, as measured around longitudinal axis 128, than the first plurality of notches 142. The first plurality of notches may have width of approximately 3.0 millimeters and the second plurality of notches may have width of approximately 4.0 millimeters. However, other dimensions for the notches are included within the scope of the present disclosure.

Figure 7:
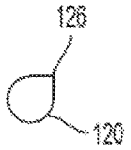
FIG. 7 is a cross-sectional view of the packing tool of FIG. 4, taken at 7-7 in FIG. 4.

FIG. 7 is a cross-sectional view, taken at 7-7 in FIG. 4, of packing tool 100. About three-fourths of the cross-sectional shape of curling portion 120 may be generally circular, while about one-fourth of the cross-sectional shape of the curling portion may be generally square, though other embodiments of the packing tool may include different proportions. A corner of this square may form the curling edge 126. The diameter of the circular portion of the curling portion may be approximately 5 millimeters, though other sizes are also possible.

Figures 8, 9, 10:
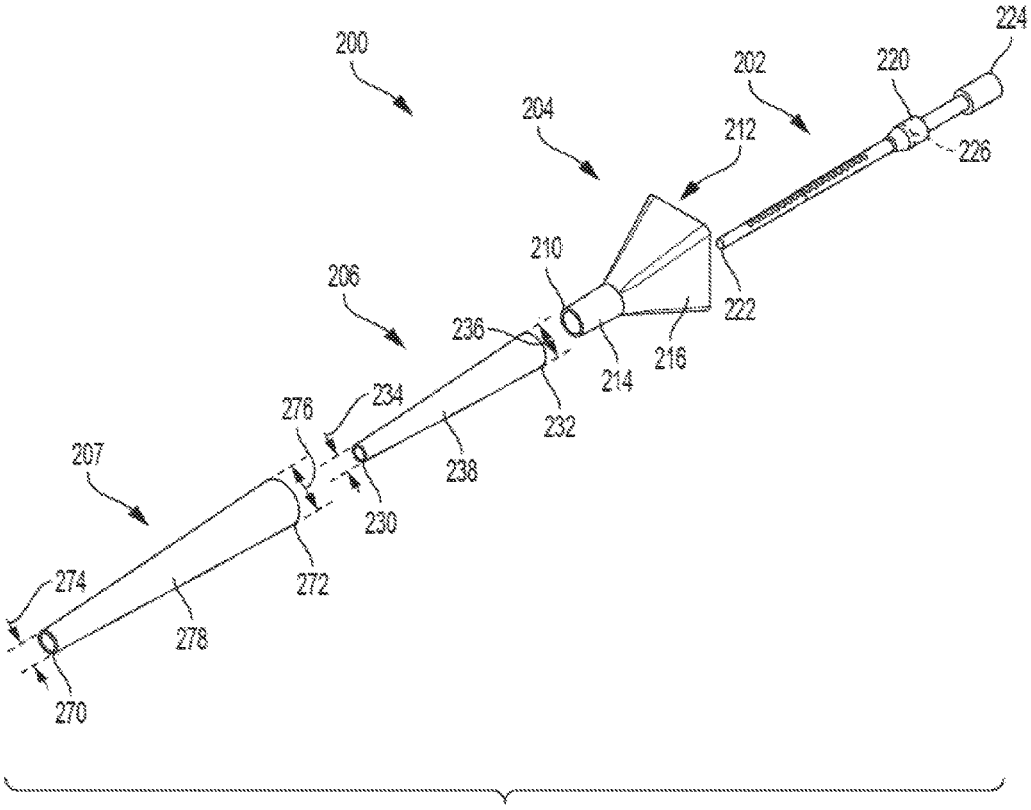
FIG. 8 is an isometric view of an illustrative system for hand-making smoking products using a packing tool in accordance with aspects of the present disclosure.
FIG. 9 is an isometric view of an example of a flexible cylindrical tube for use with the hand-making smoking product system of FIG. 8.
FIG. 10 is an isometric view of an example of a card for use with the hand-making smoking product system of FIG. 8.

FIG. 8 is an example of an illustrative system for hand-making smoking products, generally indicated at 200. System 200 may include any suitable structure configured to aid a user in hand-making smoking products. For example, system 200 may include a packing tool 202, a funnel 204, a first cone 206, and/or a second cone 207. Unless explicitly excluded, packing tool 200 may include one or more components and/or one or more functions of other packing tools described in the present disclosure. For example, packing tool 202 may include a first tamping end 222 sized to fit within a filter end of a rolled rolling paper, a second tamping end 224 sized to fit within an ignition end of a rolled rolling paper, and a handle portion 220 having a lateral dimension 226. Although system 200 is shown to include first cone 206 and second cone 207, system 200 may include any suitable number of cones, such as one cone, or a third, fourth, and/or fifth cone. In some examples, system 200 may additionally, or alternatively, include a flexible cylindrical tube 208 and/or a card 210, as shown in FIGS. 9 and 10 respectively.

The various components and/or structures of system 200 may be sized so as to partially nest relative to one another. For example, a portion of packing tool 202 may be configured to be received in funnel 204, a portion of the funnel may be configured to be received within first cone 206, and/or a portion of the first cone may be configured to be received within second cone 207. Additionally, or alternatively, a portion of the first and/or second cone may be configured to be received within flexible cylindrical tube 208. However, other suitable arrangements and/or sizes are possible.

Funnel 204 may have an output end 210 sized to fit within an ignition end of a cigarette (e.g. a rolled rolling paper) and an input end 212. Funnel 204 may be used to fill a rolled rolling paper with plant material. Funnel 204 may be sized so that a portion of the packing tool 202 between handle portion 220 and the first tamping end 222 may pass through the funnel from the input end to the output end. The lateral dimension 226 of the handle portion of the packing tool may be sized so as not to pass completely through the funnel. That is, the handle portion may fit through the input end of the funnel but not the output end. For example, the handle portion may have a diameter of approximately 9 millimeters and the output end of the funnel may have a diameter of approximately 8.5 millimeters.

Many shapes and dimensions are possible for funnel 204. For example, funnel 204 may include a cylindrical portion 214 extending approximately 18 millimeters and a flanged portion 216 extending approximately 30 millimeters. In some examples, the overall length of the funnel extending from the output end to the input end may be approximately 46 millimeters. In some examples, the input end may have a width of approximately 30 millimeters and a length of approximately 24 millimeters. Further, although input end 212 of funnel 204 is shown to have a generally rectangular shape, the input end may have any suitable shape. For example, the input end of the funnel may have a semi-circular shape to allow the funnel to be supported on a horizontal surface with both input and output ends adjacent to the horizontal surface. This may facilitate urging material supported on the horizontal surface through the funnel.

First cone 206 may have a first end 230 with a first diameter 234 and a second end 232 with a second diameter 236. First cone 206 may have a generally frustoconical shape with an outer surface 238. For example, first diameter 234 may have a smaller diameter relative to the second diameter of the second end of the first cone. Many shapes and dimensions are possible for the first cone. For example, the first cone may have an overall length of 67 millimeters with the first diameter having a diameter of approximately 7 millimeters and the second diameter having a diameter of approximately 12 millimeters. Although first cone is shown to be shaped and/or sized smaller size relative to the second cone, the first cone may have any suitable shapes and/or sizes.

Second cone 207 may have a first end 270 with a first diameter 274 and a second end 272 with a second diameter 276. Second cone 207 may have a generally frustoconical shape with an outer surface 278. For example, first diameter 274 may have a smaller diameter relative to the second diameter of the second end of the second cone. Many shapes and dimensions are possible for the second cone. For example, the second cone may have an overall length of 89 millimeters with the first diameter having a diameter of approximately 6.5 millimeters and the second diameter having a diameter of approximately 14 millimeters. Although second cone is shown to be shaped and/or sized larger size relative to the first cone, the second cone may have any suitable shapes and/or sizes.

First and/or second cones may be a solid member or a hollow shell. The outer surfaces of first and second cones may be configured about which to roll a rolling paper. Often, a hand-rolled cigarette is formed by placing plant material onto an unrolled rolling paper and then rolling the paper into a generally cylindrical or conical shape and sealing the rolled paper around the plant material. An alternate method, using the first and/or second cones of system 200, may include first rolling an empty rolling paper around the cone and sealing the empty rolling paper while the paper is disposed about the cone. Once sealed, the cone may be easily removed leaving behind a rolled rolling paper, which may be subsequently filled with plant material. When first cone 206 and/or second cone 207 is a hollow shell, the cone also may be used as a holder for a cone (such as a cone holder) or other rolled paper.

As shown in FIG. 9, system 200 may additionally, or alternatively, include flexible cylindrical tube 208. In some examples, system 200 may include two or more flexible cylindrical tubes. For example, system 200 may include a first flexible cylindrical tube and a second flexible cylindrical tube (not shown). The second flexible cylindrical tube may have different dimensions than the first flexible cylindrical tube. A portion of the first flexible cylindrical tube may be configured to be received within the second flexible cylindrical tube.

Flexible cylindrical tube 208 may have an inner surface 242 and an outer surface 244 defining an opening 246. The opening of flexible cylindrical tube may be configured to receive an existing smoking product. For example, tube 208 may be sized to receive a pre-rolled smoking product, such as a cigar. The existing smoking product may fit snugly into the flexible tube. For example, the flexible cylindrical tube may have a length of approximately 105 millimeters and the opening of the flexible cylindrical tube may have a diameter of approximately 11 millimeters. In other examples, the flexible cylindrical tube may have a length of approximately 85 millimeters and the opening of the flexible cylindrical tube may have a diameter of approximately 10 millimeters. The flexible cylindrical tube may have a uniform or variable wall thickness along the length of the tube. In some examples, the wall thickness may be approximately 0.75 millimeters. In other examples, the wall thickness may vary between 0.5 and 1 millimeter.

Flexible cylindrical tube 208 may be used to remove the initial contents of an existing smoking product. The layers of paper may then be filled with desired smokable plant material. For example, if a cigar is fitted into the flexible cylindrical tube and the tube is then rolled between the hands of a user while the tube is in a vertical orientation, the initial contents of the cigar may fall out of the cigar. This may proceed until the cigar shell is largely empty of its original contents. Emptying a cigar by this method may substantially protect the cigar shell from damage.

Flexible cylindrical tube 208 may include one or more gripper structures 240 configured to grip or secure an existing smoking product. Gripper structures 240 may include any suitable structure configured to grip or secure an existing smoking product. For example, gripper structures 240 may include one or more projections, bumps, protuberances, ribs, edges, channels, threads, notches, etc. Gripper structures 240 may include circumferentially extending channels recessed within the inner surface of the tube, while the outer surface of the tube is smooth and/or uniform. In some examples, the gripper structures may be incorporated and/or formed on the inner and/or outer surfaces. The gripper structures may extend along any suitable portion(s) of the inner and/or outer surfaces of the tube. In other examples, the gripper structure may be a separate structure that is attached to the interior of the tube. For example, the gripper structure may be a friction mesh that is attached to the interior of the tubes.

Referring now to FIGS. 8-9, the various components of system 200 for hand-making smoking products may be sized so as to partially nest relative to one another. For example, a portion of the packing tool 202 may be configured to be received in the funnel 204, a portion of the funnel may be configured to be received within the first cone 206, a portion of the first cone 206 may be configured to be received within the second cone 207, and/or a portion of the second cone 207 may be configured to be received within flexible cylindrical tube 208. Such a configuration may aid in the packing and transporting of the system. In some examples, a portion of the second cone 207 may be configured to be received within a first flexible cylindrical tube and/or a portion of the first flexible cylindrical tube may be configured to be received within a second flexible cylindrical tube.

As shown in FIG. 10, system 200 may additionally, or alternatively, include card 210. Card 210 may be configured to help a user distribute and/or position the plant material. The smokable plant material used in various cigarettes may be sticky and using the card to adjust the position and/or placement of the plant material may prevent the material from sticking to a user's fingers. Card 210 may be generally flat and have a generally rectangular shape. Card 210 may have a pair of flat planar opposed side surfaces 250 forming a bottom edge 254, a top edge 256, and a pair of rounded opposed parallel side edges 258. The side edges and top edge may be joined by smoothly curved corners 262. Card 210 may be made of one or more suitable materials, including plastic, ceramic, wood, among others. Card 210 may have any suitable dimensions, such as 75×30×1¼ millimeters.

Figure 11:
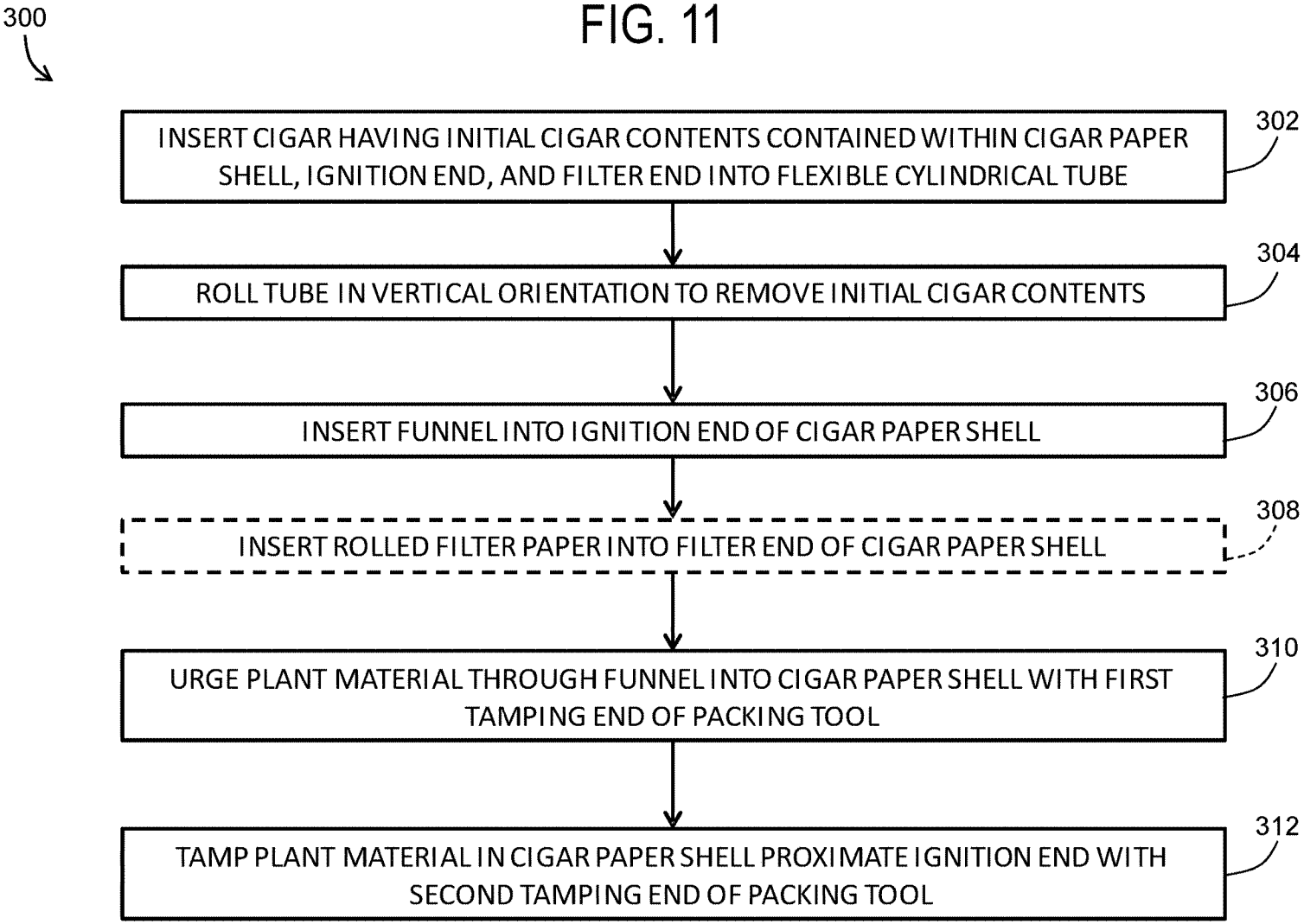
FIG. 11 is a flowchart illustrating a method of hand-making smoking products using a packing tool.

FIG. 11 depicts multiple steps of a method, generally indicated at 300 of hand-making a smoking product. Method 300 may be used in conjunction with any of the apparatus or systems depicted in and described in reference to FIGS. 1-10. Although various steps of method 300 are described below and depicted in FIG. 11, the steps need not necessarily all be performed, and in some cases may be performed in a different order than the order shown.

Method 300 may include a step 302 of inserting a cigar having initial cigar contents contained within a cigar paper shell, an ignition end, and a filter end into a flexible cylindrical tube. For example, the flexible cylindrical tube of system 200 may be sized to receive a standard-sized cigar in a snug fit.

Method 300 may include a step 304 of rolling the cylindrical tube in a vertical orientation so as to remove the initial cigar contents. Step 304 may be performed by rolling the tube back and forth in between a user's hands, for example, in the manner of a person making a snake out of clay. The flexible tube may substantially protect the cigar paper shell so that the initial contents may be removed without damaging the cigar paper shell. Once all of the initial contents of the cigar have been removed, the cigar may be re-filled with a desired smokable material.

Method 300 may include a step 306 of inserting a funnel into the ignition end of the cigar paper shell. If the funnel is sized as described in reference to FIG. 8 and the cigar is sized to fit within the flexible cylindrical tube as described in reference to FIG. 9, an output end of the funnel may easily fit within the ignition end of the cigar paper shell. The funnel may then be used to direct plant material into the cigar paper shell.

Method 300 may include a step 310 of urging plant material through the funnel into the cigar paper shell with a first tamping end of a packing tool. While filling the cigar paper shell with plant material using a funnel the plant material may become lodged or stuck in a narrow portion of the funnel. If a packing tool, such as packing tool 202 described in reference to FIG. 8, is used to urge plant material through a funnel, such as funnel 204 described in reference to FIG. 8, the first tamping end of the packing tool may be sized so as to pass completely through the funnel, dislodging any plant material which may be stuck. This may continue until the cigar paper shell is filled with plant material.

Method 300 may include a step 312 of tamping the plant material in the cigar paper shell proximate the ignition end with a second tamping end of a packing tool. If the packing tool is sized as described in reference to FIG. 8 and the cigar is sized to fit within the flexible cylindrical tube as described in reference to FIG. 9, the second end of the packing tool may easily fit within the ignition end of the cigar paper shell.

Tamping or packing the plant material within the rolling paper may prevent plant material from falling out of the cigar and may improve the smoking quality of the cigar.

Method 300 may optionally include a step 308 of inserting a rolled filter paper into the filter end of the cigar paper shell. The rolled filter paper may be inserted into the filter end of the cigar paper shell either before or after the cigar paper shell has been filled with plant material. In the case where the filter paper is inserted before the plant material is added, a rolled filter paper of any desired size may be inserted. In the case where the filter paper is inserted after the plant material is added, inserting the filter paper may include tamping plant material in the cigar paper shell proximate the filter end with the first tamping end of the elongate packing tool. Tamping the plant material proximate the filter end may create a space in which to insert the rolled filter paper.

Figure 12:
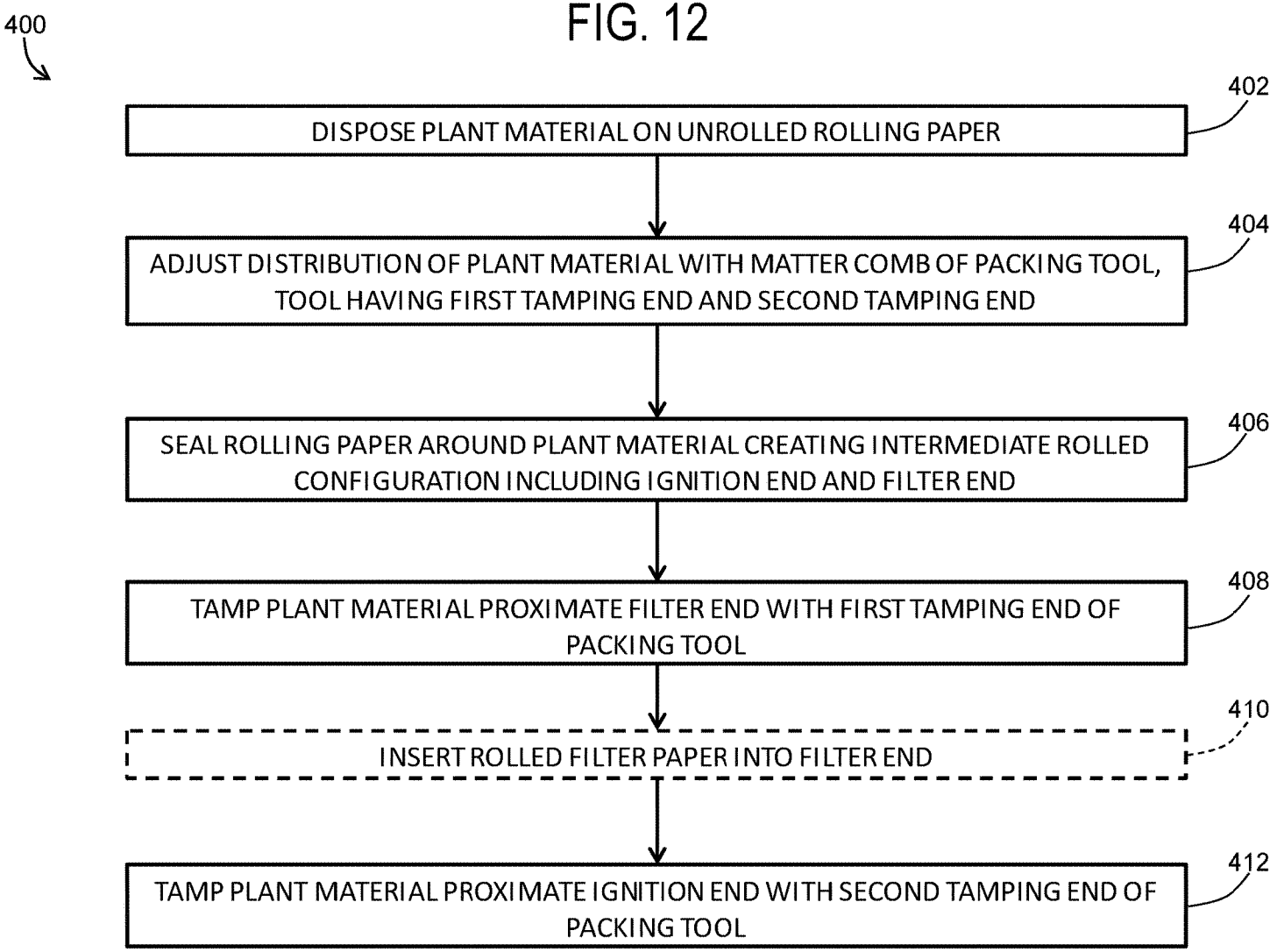
FIG. 12 is a flowchart illustrating another method of hand-making smoking products using a packing tool.

FIG. 12 depicts multiple steps of a method, generally indicated at 400 of hand-making a smoking product. Method 400 may be used in conjunction with any of the apparatus or systems depicted in and described in reference to FIGS. 1-10. Although various steps of method 400 are described below and depicted in FIG. 12, the steps need not necessarily all be performed, and in some cases may be performed in a different order than the order shown.

Method 400 may include a step 402 of disposing plant material on an unrolled rolling paper. A user may hold an unrolled rolling paper horizontally in one hand and add plant material onto the unrolled rolling paper with the other hand or any other suitable means.

Method 400 may include a step 404 of adjusting the distribution of plant material on the unrolled rolling paper with a matter comb of a packing tool, the packing tool having the matter comb, a first tamping end, a second tamping end. For example, a packing tool such as described in reference to FIGS. 2-3 or FIGS. 4-7 may be used to adjust the position of the plant material on the unrolled rolling paper. The adjusting may include making a more even distribution of plant material along the long direction of the cigarette. Adjusting the distribution of plant material may also include compressing the plant material with the packing tool as the rolling paper is rolled around the plant material. The smokable plant material used in various cigarettes may be sticky and using the packing tool to adjust the position of the plant material may prevent the material from sticking to a user's fingers.

Method 400 may include a step 406 of sealing the rolling paper around the plant material, thereby creating an intermediate rolled configuration including an ignition end and a filter end. Sealing the rolling paper may involve wetting a sealing edge of the rolling paper and pressing the wetted sealing edge of the rolling paper to another portion of the rolled paper, so that the rolled rolling paper has the general shape of a cylinder with the plant material on the inside.

Method 400 may include a step 408 of tamping the plant material in the rolled rolling paper proximate the filter end with the first tamping end of the packing tool. If the packing tool is sized as described in reference to FIG. 8, the first tamping end may fit within the filter end of a typically sized hand-rolled cigarette. Tamping the plant material may create space for a rolled filter paper to be inserted, may prevent plant material from falling out of the cigarette, and may improve the smoking quality of the cigarette. If a filter paper is not to be inserted the rolling paper may be twisted closed at the filter end.

Method 400 may include a step 412 of tamping the plant material in the rolled rolling paper proximate the ignition end with the second tamping end of the packing tool. If the packing tool is sized as described in reference to FIG. 8, the second tamping end may fit within the ignition end of a typically sized hand-rolled cigarette. Tamping the plant material may prevent plant material from falling out of the cigarette and may improve the smoking quality of the cigarette. The rolling paper may then be twisted closed at the filter end.

Method 400 may optionally include a step 410 of inserting a rolled filter paper into the filter end of the cigarette. Inserting the rolled filter paper may include measuring a depth of space for a rolled filter paper within the filter end with a set of ruler markings disposed proximate the first tamping end of the elongate packing tool. Measuring the depth of space may be performed after the plant material proximate the filter end has been tamped with the packing tool. Inserting the filter paper may further include curling a portion of filter paper with a paper curling portion of the packing tool, such as described in reference to FIGS. 2-3 and FIGS. 4-7, and rolling the curled portion of filter paper.

Figure 13:
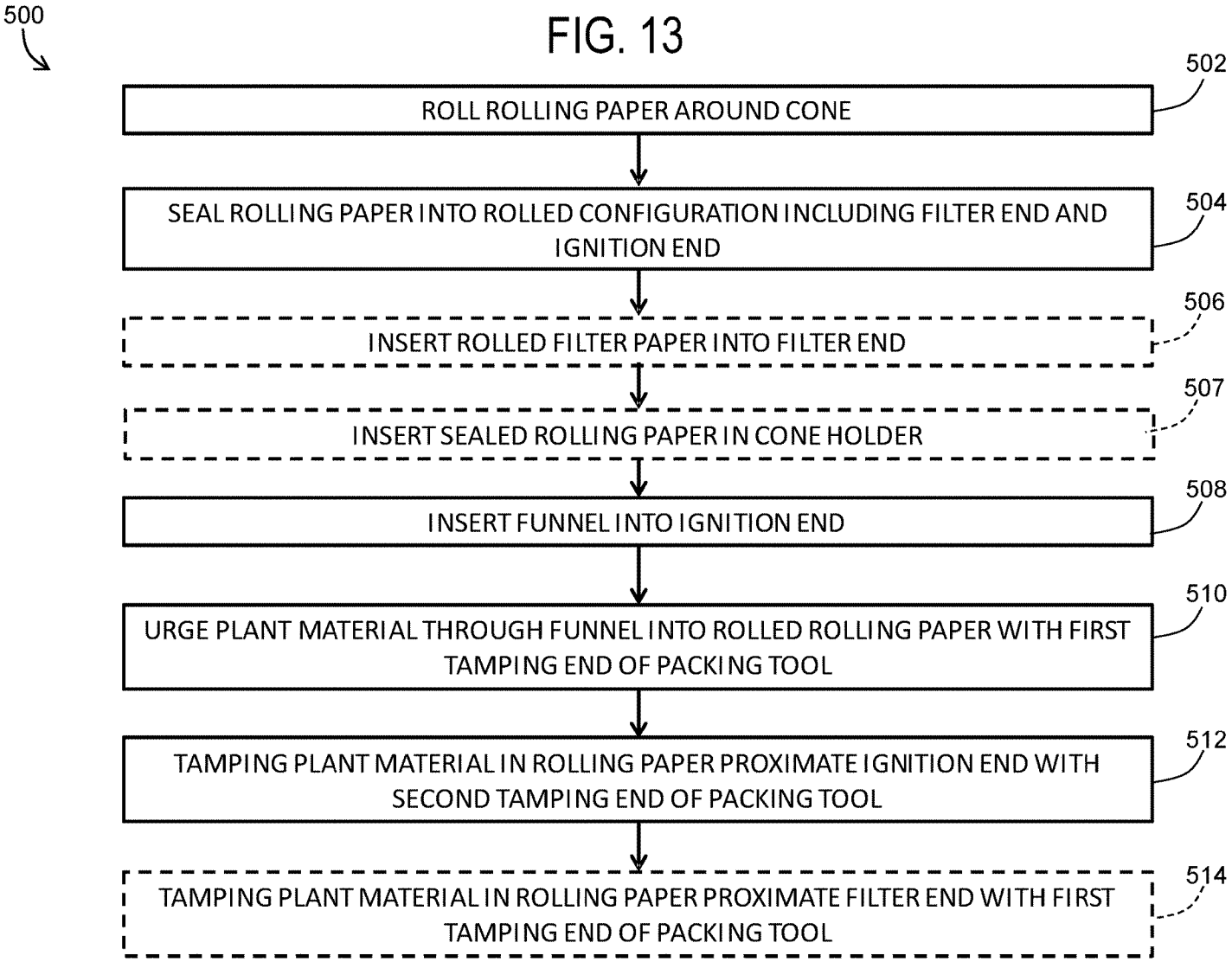
FIG. 13 is a flowchart illustrating still another method of hand-making smoking products using a packing tool.

FIG. 13 depicts multiple steps of a method, generally indicated at 500, of hand-making a smoking product. Method 500 may be used in conjunction with any of the apparatus or systems depicted in and described in reference to FIGS. 1-10. Although various steps of method 500 are described below and depicted in FIG. 13, the steps need not necessarily all be performed, and in some cases may be performed in a different order than the order shown.

Method 500 may include a step 502 of rolling a rolling paper around a cone and a step 504 of sealing the rolled rolling paper into a rolled configuration including a filter end and an ignition end. It may be difficult to consistently roll a rolling paper into a desirable shape for a cigarette and using a cone as a substrate on which to roll the paper may add ease and repeatability to the process. Once the rolling paper has been rolled and sealed into the rolled configuration, the rolled rolling paper may have a generally conical or frusto-conical shape and the cone may be removed. The filter end may be narrower than the ignition end of the rolled rolling paper.

Method 500 may include a step 508 of inserting a funnel into the ignition end of the rolled rolling paper. If the funnel and the cone is sized as described in reference to FIG. 8, an output end of the funnel may easily fit within the ignition end of the rolled rolling paper. The funnel may then be used to direct plant material into the rolled rolling paper.

Method 500 may include a step 510 of urging plant material through the funnel into the rolled rolling paper with a first tamping end of a packing tool. While filling the rolled rolling paper with plant material using a funnel the plant material may become lodged or stuck in a narrow portion of the funnel. If a packing tool, such as tool 202 described in reference to FIG. 8, is used to urge plant material through a funnel, such as funnel 204 described in reference to FIG. 8, the first tamping end of the packing tool may be sized so as to pass completely through the funnel, dislodging any plant material which may be stuck. This may continue until the rolled rolling paper is filled with plant material.

Method 500 may include a step 512 of tamping the plant material in the rolled rolling paper proximate the ignition end with a second tamping end of the packing tool. If the packing tool is sized as described in reference to FIG. 8 and the cone used to roll the rolling paper is sized as described in reference to FIG. 8, the second end of the packing tool may easily fit within the ignition end of the rolled rolling paper. Tamping or packing the plant material within the rolling paper may prevent plant material from falling out of the rolling paper and may improve the smoking quality of the cigarette.

Certain individuals may choose to include filters or rolled filter papers in their hand-rolled cigarettes. Method 500 may optionally include adding a rolled filter paper in at least two ways, see steps 506 and 514 described below.

Method 500 may optionally include a step 506 of inserting a rolled filter paper into the filter end. Step 506 may be performed after the rolling paper has been rolled and sealed in the rolled configuration and before any plant material has been added to the rolled rolling paper. In such a case a rolled filter paper of a desired length may be inserted.

In one example, step 506 may include inserting a rolled filter paper into the filter end. Additionally, step 506 may include measuring a depth of space for the rolled filter paper within the filter end with a set of ruler markings disposed proximate the first tamping end of the packing tool. When the rolling paper is sealed around the cone in step 504, the rolling paper may extend beyond the small end of the cone, thereby leaving space proximate the filter end for a rolled filter paper while the cone still supports the majority of the rolled rolling paper. The depth of space may be measured with the set of ruler markings. An appropriately sized rolled filter paper may then be constructed and inserted into the filter end. After the filter paper has been inserted the cone may be removed and the rolled rolling paper filled with plant material as described above.

Method 500 may optionally include a step 507 in which the sealed rolling paper in the rolled configuration is placed into a cone holder, such as when cone 206 is a hollow shell.

In another example, the rolled rolling paper may be filled with plant material prior to the insertion of the rolled filter paper. Method 500 may optionally include a step 514 of tamping the plant material in the rolled rolling paper proximate the filter end with the first tamping end of the elongate packing tool. If the packing tool and the cone is sized such as described in reference to FIG. 8, the first end of the packing tool may fit within the filter end of the rolled rolling paper. Tamping or packing the plant material proximate the filter end may create space for the filter paper to be inserted and may improve the smoking characteristics of the cigarette. The depth of space for a rolled filter paper within the filter end may be measured with the set of ruler markings disposed proximate the first tamping end of the elongate packing tool. An appropriately sized rolled filter paper may then be constructed and inserted into the filter end.

Figure 14:
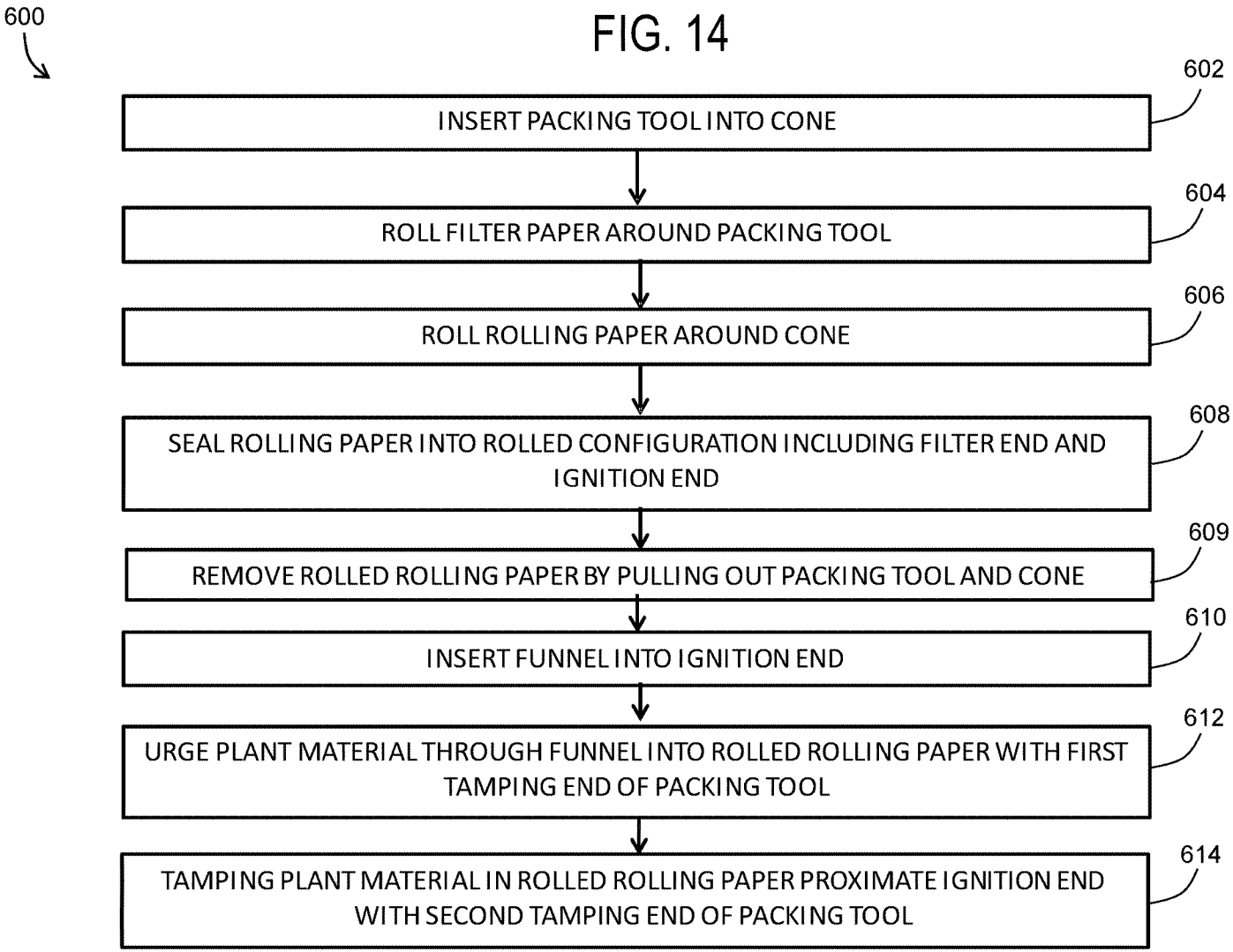
FIG. 14 is a flowchart illustrating yet another method of hand-making smoking products using a packing tool.

FIG. 14 depicts multiple steps of a method, generally indicated at 600, of hand-making a smoking product. Method 600 may be used in conjunction with any of the apparatus or systems depicted in and described in reference to FIGS. 1-10. Although various steps of method 600 are described below and depicted in FIG. 14, the steps need not necessarily all be performed, and in some cases may be performed in a different order than the order shown.

Method 600 may include a step 602 of inserting a first tamping end of a packing tool into an ignition end of a cone such that the second tamping end of packing tool is positioned proximate to an ignition end of cone. If the packing tool is sized as described in reference to FIG. 8 and the cone is sized as described in reference to FIG. 8, the first tamping end of the packing tool may easily fit within the ignition end of the cone. In some examples, the second tamping end of the packing tool may be sized so as not to pass completely through a portion of the cone proximate the ignition end of the cone. A portion of the packing tool proximate the first tamping end of the packing tool may extend from the filter end of the cone.

Method 600 may include a step 604 of rolling a filter paper around a portion of the packing tool proximate the filter end of the cone. In some examples, the portion of the packing tool proximate the filter end of the cone may be disposed proximate the first tamping end of the packing tool. The filter paper may be of any desired length.

Method 600 may include a step 606 of rolling a rolling paper around the rolled filter paper and the cone, and a step 608 of sealing the rolled rolling paper into a rolled configuration including a filter end and an ignition end. The rolled filter paper may be disposed proximate the filter end of the rolled paper. Once the rolled rolling paper has been rolled and sealed into the rolled configuration, the rolled rolling paper may have a generally conical or frustoconical shape Method 600 may include a step 609 of removing the rolled rolling paper from the cone and packing tool. The rolled rolling paper may be removed by pulling out the packing tool and cone from the rolled rolling paper. In some examples, removing the rolled rolling paper may include holding the filter end of the rolled rolling paper and holding the second tamping end of the packing tool, and pulling the rolled rolling paper and/or packing tool away from the other. In some examples, the rolled filter paper may be attached and/or formed with the rolled rolling paper. The filter end may be narrower than the ignition end of the rolled rolling paper.

Method 600 may include a step 610 of inserting a funnel into the ignition end of the rolled rolling paper. If the funnel and the cone is sized as described in reference to FIG. 8, an output end of the funnel may easily fit within the ignition end of the rolled rolling paper. The funnel may then be used to direct plant material into the rolled rolling paper.

Method 600 may include a step 612 of urging plant material through the funnel into the rolled rolling paper with the first tamping end of the packing tool. While filling the rolled rolling paper with plant material using a funnel the plant material may become lodged or stuck in a narrow portion of the funnel. If a packing tool, such as tool 202 described in reference to FIG. 8, is used to urge plant material through a funnel, such as funnel 204 described in reference to FIG. 8, the first tamping end of the packing tool may be sized so as to pass completely through the funnel, dislodging any plant material which may be stuck. This may continue until the rolled rolling paper is filled with plant material.

Method 600 may include a step 614 of tamping the plant material in the rolled rolling paper proximate the ignition end with the second tamping end of the packing tool. If the packing tool is sized as described in reference to FIG. 8 and the cone used to roll the rolling paper is sized as described in reference to FIG. 8, the second end of the packing tool may easily fit within the ignition end of the rolled rolling paper. Tamping or packing the plant material within the rolling paper may prevent plant material from falling out of the rolling paper and may improve the smoking quality of the cigarette.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A packing tool, comprising:

an elongate body having a longitudinal axis, a first tamping end and a second tamping end opposite the first tamping end; and a handle attached to, or formed with, the elongate body, the handle is disposed between the first and second tamping ends, and the handle extends outward from the elongate body;

wherein the elongate body includes a single row of troughs proximate the first tamping end configured to distribute material of a smoking product, wherein the troughs have a larger dimension transverse to the longitudinal axis of the elongate body than their dimension along the longitudinal axis of the elongate body;

wherein the first tamping end has a first width sized to fit within a filter end of a smoking product, and the second tamping end has a second width sized to fit within an ignition end of a smoking product, the second width is larger than the first width.

2. The packing tool of claim 1, further including a set of ruler markings proximate the first tamping end.

3. The packing tool of claim 2, wherein the set of ruler markings is a plurality of notches recessed in the elongate body.

4. The packing tool of claim 1, further including a paper curling portion configured to allow a user to curl a portion of filter paper.

5. The packing tool of claim 4, wherein the first tamping end, the handle, the paper curling portion, and the second tamping end are disposed sequentially along the longitudinal axis of the elongate body.

6. The packing tool of claim 4, wherein the paper curling portion has at least one edge disposed parallel to the longitudinal axis of the elongate body.

7. The packing tool of claim 4, wherein the elongate body, the handle, the single row of troughs, and the curling portion are formed as a one piece unitary construction.

8. The packing tool of claim 1, wherein the handle has an enlarged lateral dimension relative to the first tamping end.

9. The packing tool of claim 1, wherein the single row of troughs is recessed in the elongate body.

10. The packing tool of claim 1, wherein the first width is approximately 6 millimeters and the second width is approximately 9 millimeters.

11. A system for hand-making smoking products, comprising:

at least one cone;

a funnel; and a packing tool that includes an elongate body having a longitudinal axis, a first tamping end and a second tamping end opposite the first tamping end, wherein the elongate body includes a single row of troughs proximate the first tamping end configured to distribute material of a smoking product, wherein the troughs have a larger dimension transverse to the longitudinal axis of the elongate body than their dimension along the longitudinal axis of the elongate body, a handle attached to, or formed with, the elongate body, the handle is disposed between the first and second tamping ends, and the handle extends outward from the elongate body, a set of ruler markings proximate the first tamping end, and a paper curling portion configured to allow a user to curl a portion of filter paper;

wherein the at least one cone has an outer surface configured about which to roll a rolling paper, the funnel has an output end sized to fit within an ignition end of the rolled rolling paper so as to fill the rolled rolling paper with plant material, the first tamping end of the packing tool has a first width sized to fit within a filter end of the rolled rolling paper and through the funnel, and the second tamping end of the packing tool has a second width sized to fit within the ignition end of the rolled rolling paper, the second width larger than the first width.

12. The system of claim 11, further comprising a flexible cylindrical tube configured to receive an existing smoking product.

13. The system of claim 12, wherein the at least one cone includes a first cone and a second cone, the second cone having different dimensions than the first cone.

14. The system of claim 13, wherein a portion of the packing tool is configured to be received in the funnel, a portion of the funnel is configured to be received within the first cone, a portion of the first cone is configured to be received within the second cone, and a portion of the second cone is configured to be received within the flexible cylindrical tube.

15. A method of hand-making smoking products, comprising:

inserting a funnel into an ignition end of a rolled rolling paper, wherein the rolled rolling paper has a filter end and an ignition end;

urging plant material through the funnel into the rolled rolling paper with a first tamping end of a packing tool, wherein the packing tool includes an elongate body having a longitudinal axis, a first tamping end and a second tamping end opposite the first tamping end, a handle attached to, or formed with, the elongate body, the handle is disposed between the first and second tamping ends, a single row of troughs proximate the first tamping end configured to distribute material of a smoking product, wherein the troughs have a larger dimension transverse to the longitudinal axis of the elongate body than their dimension along the longitudinal axis of the elongate body, a set of ruler markings proximate the first tamping end, and a paper curling portion configured to allow a user to curl a portion of filter paper, thereby filling the rolled rolling paper with plant material, tamping the plant material in the rolled rolling paper proximate the ignition end with the second tamping end of the packing tool.

16. The method of claim 15, further comprising inserting a rolled filter paper into the filter end.

17. The method of claim 16, wherein inserting a rolled filter paper into the filter end includes measuring a depth of space for the rolled filter paper within the filter end with the set of ruler markings.

18. The method of claim 15, further comprising tamping the plant material in the rolled rolling paper proximate the filter end with the first tamping end of the packing tool.

19. The method of claim 15, further comprising rolling a rolling paper around a cone, the cone comprising a hollow shell, sealing the rolled paper into a rolled configuration, removing the rolled rolling paper from the cone, and placing the rolled rolling paper into the hollow portion of the cone.

* * * * *